US008328463B2

(12) United States Patent
Dudley et al.

(10) Patent No.: US 8,328,463 B2
(45) Date of Patent: Dec. 11, 2012

(54) REFLECTIVE ROAD MARKER

(75) Inventors: Martin Dudley, Bridgnorth (GB); Daniel Rowntree, Kenilworth (GB); Robert Menear, Sutton Coldfield (GB)

(73) Assignee: Thomas Dudley Limited, West Midlands (GB)

( * ) Notice: Subject to any disclaimer, the term of this patent is extended or adjusted under 35 U.S.C. 154(b) by 0 days.

(21) Appl. No.: 12/681,773

(22) PCT Filed: Oct. 6, 2008

(86) PCT No.: PCT/GB2008/050911

§ 371 (c)(1), (2), (4) Date: Jun. 30, 2010

(87) PCT Pub. No.: WO2009/044212

PCT Pub. Date: Apr. 9, 2009

(65) Prior Publication Data

US 2010/0310311 A1 Dec. 9, 2010

(30) Foreign Application Priority Data

| | | |
|---|---|---|
| Oct. 5, 2007 | (GB) | 0719480.6 |
| Oct. 22, 2007 | (GB) | 0720605.5 |
| Sep. 2, 2008 | (GB) | 0815916.2 |

(51) Int. Cl.
*E01F 9/06* (2006.01)
*E01F 9/00* (2006.01)

(52) U.S. Cl. ..... 404/16; 404/14; 362/153.1

(58) Field of Classification Search ..... 404/10–169, 404/12–16; 362/152–153.1
See application file for complete search history.

(56) References Cited

U.S. PATENT DOCUMENTS

| | | | | | |
|---|---|---|---|---|---|
| 1,265,386 | A * | 5/1918 | Richards | 362/153.1 |
| 1,267,967 | A * | 5/1918 | Brunnworth et al. | 362/153.1 |
| 1,572,214 | A * | 2/1926 | McEwing et al. | 362/153.1 |
| 1,589,972 | A * | 6/1926 | Knauber | 362/367 |
| 3,924,958 | A * | 12/1975 | Rowland | 404/15 |
| 4,854,768 | A * | 8/1989 | Flanagan et al. | 404/11 |
| 4,955,982 | A * | 9/1990 | Paulos | 404/11 |
| 5,074,706 | A * | 12/1991 | Paulos | 404/12 |
| 5,302,048 | A | 4/1994 | Paulos et al. | |
| 5,529,430 | A * | 6/1996 | Jenkins | 404/11 |
| 5,857,801 | A | 1/1999 | Brown | |
| 5,895,170 | A | 4/1999 | Chambers et al. | |
| 6,062,766 | A * | 5/2000 | Fleury et al. | 404/11 |
| 6,789,915 | B2 * | 9/2004 | Van Der Poel et al. | 362/153.1 |
| 2008/0179791 | A1 * | 7/2008 | Bown et al. | 264/328.1 |

FOREIGN PATENT DOCUMENTS

| | | |
|---|---|---|
| EP | 1655413 | 5/2006 |
| FR | 2480323 | 10/1981 |
| GB | 845613 | 8/1960 |
| GB | 2062731 | 5/1981 |
| WO | WO 02092915 | 11/2002 |

* cited by examiner

*Primary Examiner* — Raymond W Addie
(74) *Attorney, Agent, or Firm* — Ober, Kaler, Grimes & Shriver; Royal W. Craig

(57) ABSTRACT

An embedded-type reflective road marker (1) which includes a base (2) and a reflector (3) for reflecting light cast onto the marker. The reflector (1) is detachably connected or secured, in use, to the base (2) by a connector (4) having release means (40) for facilitating removal of the reflector (3) from the base (2).

10 Claims, 10 Drawing Sheets

REFLECTIVE ROAD MARKER

This invention relates to an embedded-type reflective road marker. In general, there are two distinct types of reflective road marker, both of which are used to mark relevant features on a road surface, typically the centre line and shoulder lines.

The first of these types, surface mounted reflective road markers, have a generally flat base which can be fixed to the road surface, normally by means of a suitable adhesive. Such road markers, which are generally cheaper to manufacture and install, are frequently dislodged from the road surface as a result of impacts from the tyres of passing vehicle. The second of these types, embedded type road markers, are partially embedded in the road surface and are accordingly less susceptible to dislodgement.

The present invention is particularly concerned with the latter of type of road marker.

A currently popular embedded-type road marker has an upper shell of moulded glass or other suitable reflector. The shell is mounted to a base structure, usually by a suitable adhesive. In use, a lower part of the shell and the base structure are recessed and fixed in a hole cut for the purpose in the road surface, thereby anchoring the marker.

In operation, at least a portion of the light cast onto the marker by the headlights of an approaching vehicle is reflected back to the eyes of the driver of the vehicle, the light passing through the glass shell both on entry into and exit from the marker.

One problem with the known markers of this type is that, in use, current reflectors lose their reflectivity over 6 months to 2 years and have to be replaced regularly. With currently available systems, this is a time consuming exercise because it requires removal of the base from the road by digging up the road or, in the case of "Shaw" type reflectors, separation of the reflector from the base by applying air at high pressure to the reflectors.

A further problem with the known markers of this type results from the desirability of providing different reflected light colours for markers which are to designate different road features. For instance, normal practice is that a centre line marker should reflect white or red light depending on whether the centre line is a broken line, implying that overtaking is permitted, or is solid, implying that overtaking is prohibited, and that a shoulder lane marker should reflect yellow or amber light.

Occasionally, it is desirable to change the colour of the marker, but to do so it is necessary to remove the embedded marker and replace it with another.

It is an object of the reflector of the present invention to overcome, or at least to mitigate, the problems associated with the prior art.

According to one aspect of the present invention, there comprises an embedded-type reflective road marker comprising a base and a reflector for reflecting light cast onto the marker, wherein the reflector is detachably connected or secured, in use, to the base by a connector having release means for facilitating removal of the reflector from the base.

The use of a detachable connection between the reflector and the base simplifies the procedure for removing and/or replacing the reflector.

The release means may comprise a catch means such as one or more clips or retractable pins. The clip may be resiliently biased, in use, toward the base, for example to provide an interference or snap fit therewith. The clip may be releasably engageable with the base, for example in a cantilevered snap fit arrangement. The clip may comprise a projection, for example at or adjacent its free end, which may engage, in use, a recess or aperture of the base.

The marker may comprise a second clip, for example disposed on an opposite side of the reflector to the first clip. The second clip may be resiliently biased, in use, toward the base, for example to provide an interference or snap fit therewith. The second clip may include a further projection at or adjacent its free end. The further projection may engage, in use, a further recess or aperture of the base.

The connector may be formed integrally with the reflector and/or secured, for example releasably or permanently secured, thereto.

The reflector preferably comprises a body and one or more reflective surfaces, for example one or more reflective strips which may be secured to the body or formed integrally therewith. The body may be symmetrical and/or substantially trapezoidal in cross section with the reflective surfaces on its non-parallel sides.

The reflective surfaces may be different, for example they may comprise different colours, which may be advantageous when the body is symmetrical. For example, the reflective characteristics of the reflector may be varied based on its orientation, wherein the detachable connection could facilitate the reconfiguration thereof.

The connector may comprise a reflector retention cartridge, for example which is provided with clamping means.

According to a second aspect of the invention, there comprises an embedded-type reflective road marker comprising a reflector retained by a reflector retention cartridge to reflect light cast onto the marker in use, wherein the reflector retention cartridge is detachably secured to a base.

The reflector retention cartridge may be provided with clamping means to clamp the reflector to the cartridge. Optionally, the clamping means comprises opposed protruding portions extending inwardly and adapted to engage the reflector.

In one class of embodiments, the reflector has opposed shoulders to engage the protruding portions of the clamping means. Alternatively, the reflector comprises opposed apertures formed in the body of the reflector for receiving corresponding protruding portions of the clamping means to be engaged therein.

Alternatively, the reflector may be secured to the reflector retention cartridge by adhesive.

The reflector retention cartridge may comprise first and second members that slidably engage the reflector to secure said reflector to the cartridge. In one class of embodiments, the first and second members are provided with interengaging means to lock the cassette in a reflector engaged position. Optionally, the reflector retention cartridge is provided with one or more inner guides to guide the first and second members between open and locked positions.

The reflector retention cartridge may be provided with opposed flexible clips to be retained by said base.

In some embodiments, the connector or the reflector retention cartridge is provided with a flexural member adapted to flex from an upward apex at rest to a depressed position within the base, thereby causing the outer parts of the cartridge to move inwardly to clamp a reflector thereto. Preferably, the flexural members are compressed within the base, to maintain the cartridge within the base.

In another class of embodiments, the connector or the reflector retention cartridge is provided with a pivot and the opposing parts of the connector or cartridge are pivotable about the pivot to provide an over-centre fitment.

In order to further elucidate the invention, exemplary non-limiting embodiments will now be described with reference to the accompanying diagrammatic drawings, in which.

Figure 1:
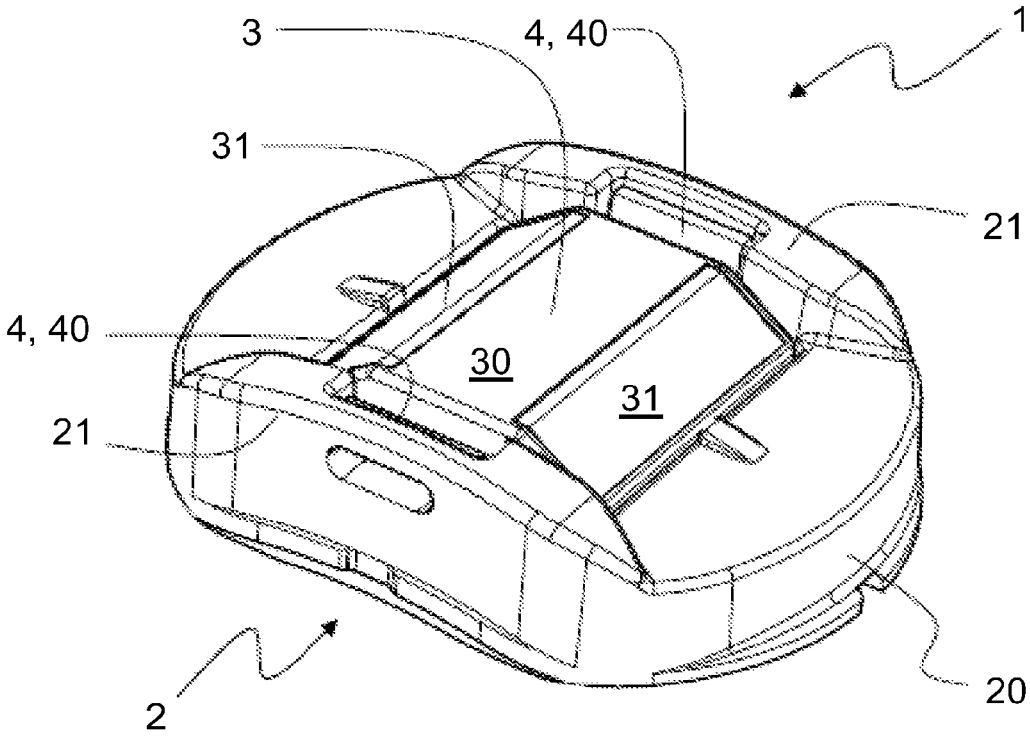
FIG. 1 is a perspective view a road marker according to a first embodiment of the invention.
Figure 2:
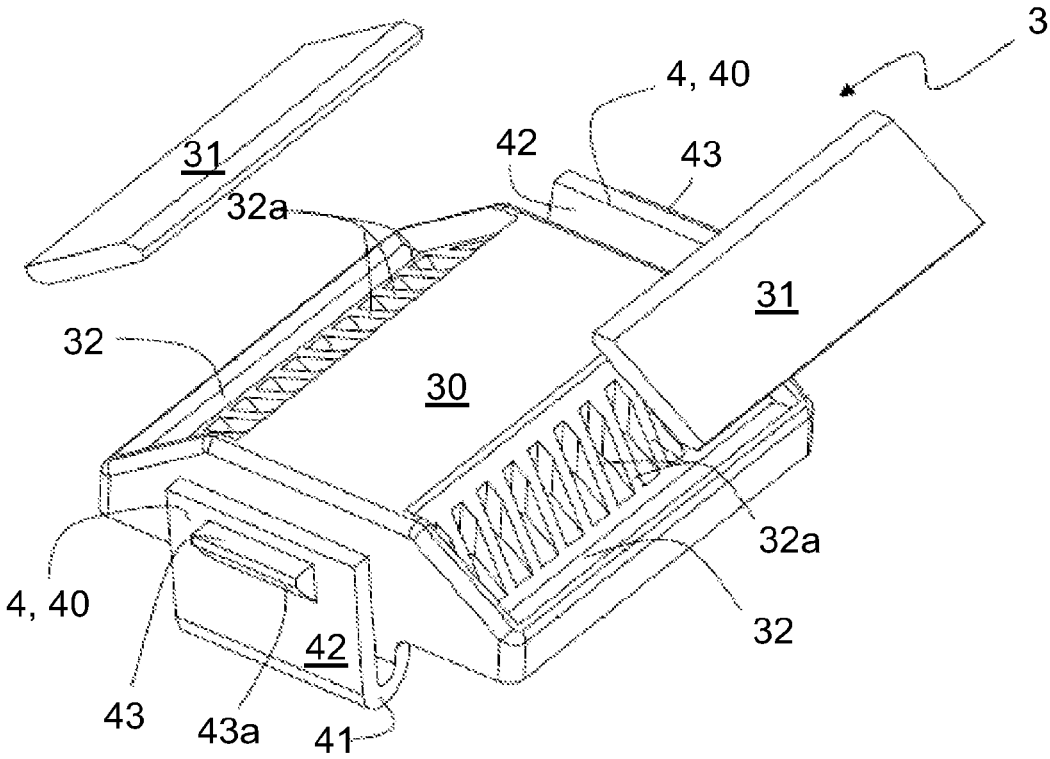
FIG. 2 is an exploded perspective view of the reflector of the road marker of FIG. 1.
Figure 3:
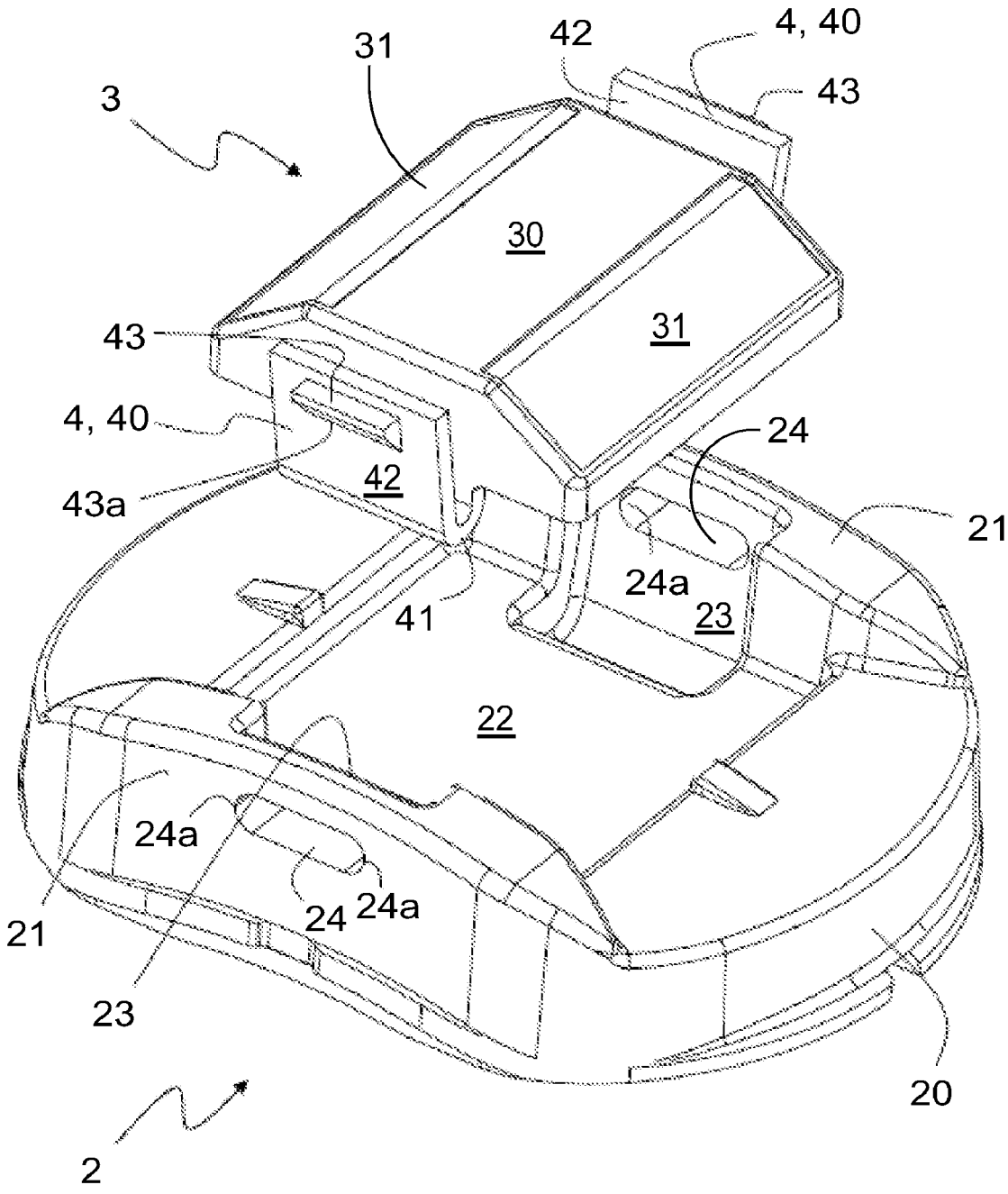
FIG. 3 is a partially exploded view of the road marker of FIG. 1.

Referring to FIGS. 1 to 3, there is shown an embedded-type reflective road marker 1 according to a first embodiment of the invention. The marker 1 includes a base 2, a reflector 3 for reflecting light cast onto the marker in use and a pair of connectors 4 for releasably securing reflector 3 to the base 2. In use, the base 2 is fitted to the road in a conventional manner.

The base 2 is manufactured from cast iron in this embodiment and includes a main body 20 which is substantially oval in plan and a pair of opposed side walls 21 extending upwardly from the longitudinal edges of the main body 20. The base also includes a substantially rectangular central depression 22 extending between the side walls 21 for receiving the reflector 3 and a pair of opposed recesses 23, each of which extends from the top of a respective side wall 21 and into the central depression 22.

Each side wall 21 includes a horizontally elongate slot or hole 24 with rounded end edges 24*a*. Each slot 24 is adjacent the upper edge of the side wall 21 and extends from the base of a respective recess 23 through the thickness of the side wall 21.

The reflector 3 is substantially trapezoidal in cross section and includes a reflector body 30 and a pair of reflective strips 31. The reflector body 30 is formed of moulded plastics material and includes a pair of recesses 32 on the non-parallel surfaces of the trapezoidal shape for receiving the reflective strips. The base of each recess 32 is formed of a series of ribs 32*a* to the peaks of which the reflective strips 31 are secured, for example by ultrasonic welding or using a suitable adhesive. The reflective strips 31 are of the type known in the art, selected for the particular application in question.

Each connector 4 is in the form of a catch or clip 40 formed integrally with the reflector body 30 and arranged to provide a snap fit with the base 2 in this embodiment. The clip 40 is in the form of a thin wide arm with a rectangular cross section and includes a curved resilient portion 41 and a straight portion 42 with an outwardly extending elongate projection 43 adjacent its free end.

The resilient portion 41 is formed integrally along its edge to the bottom of the reflector body 30, whereby the clip 40 curves upwardly such that the straight portion 42 extends substantially vertically in use. The projection 43 protrudes away from the reflector body and extends parallel to the free edge of the straight portion 42 with a sloping downwardly facing surface 43*a*.

Figure 4:
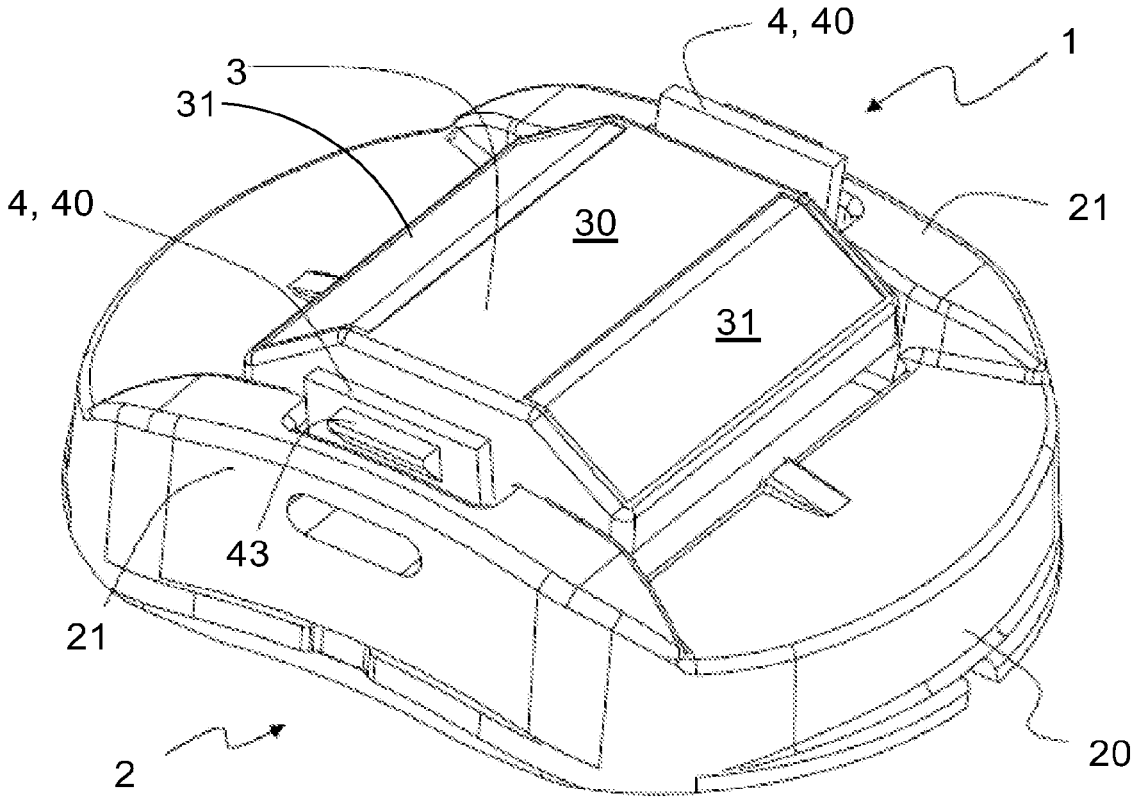
FIG. 4 is a perspective view of the road marker of FIG. 1 with the reflector partially inserted into the base.

In use and referring now to FIGS. 3 and 4, the reflector 3 is lowered into the central depression 22 of the base 2 such that the clips 40 are located in the recesses 23. The reflector 3 is then urged downwardly toward the base 2 such that the downwardly facing surfaces 43*a* of the projections 43 contact the upper edge of the side walls 21 of the base 2, which surface 43*a* functions as a lead in taper. This in turn pushes the straight portion 42 toward the reflector and deforms the resilient portion 41 of the clip 40 until the projections 43 are aligned with the slots 24, at which point they snap therein. This arrangement provides a cantilever snap fit effect to retain the reflector 3 in place.

Figure 5:
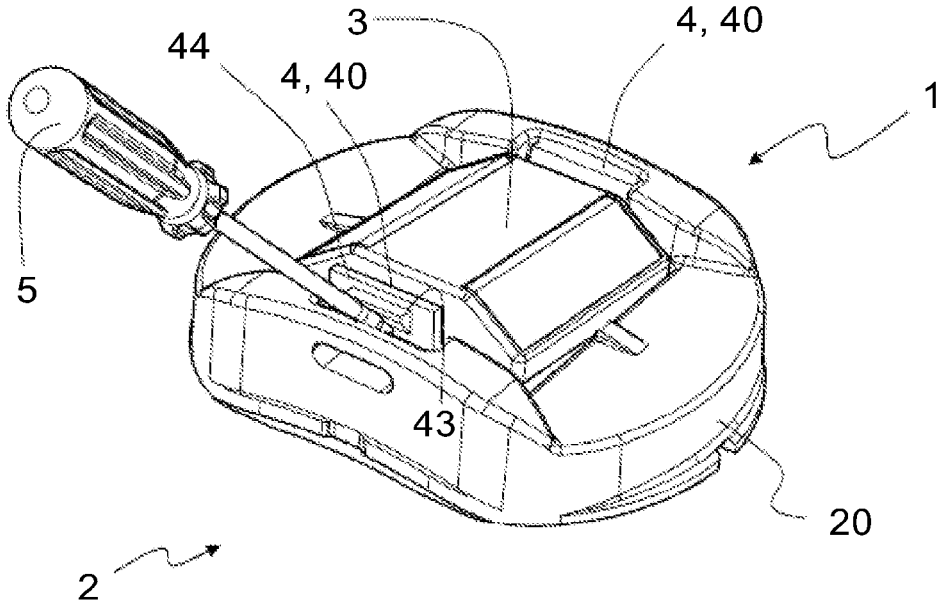
FIG. 5 illustrates the removal of the reflector from the base in the road marker of FIG. 1.
Figure 6:
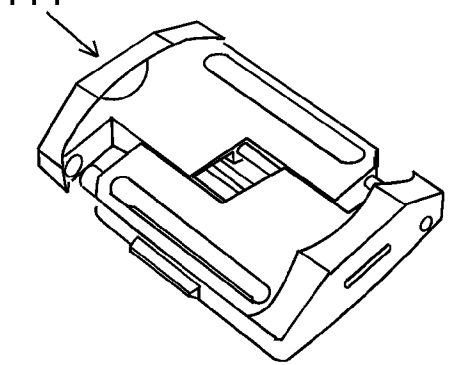
FIGS. 6 to 16 illustrate various views of a road reflector according to a second embodiment of the invention.

As shown in FIG. 5, in order to remove the reflector 3 from the base 2 the end of a screwdriver 5 may be inserted between an outer upper portion 44 of the clip 40 and the base of one of the recesses 23 and twisted to urge them apart. The end of the screwdriver 5 may then be urged between the projection 43 and the base of the recess 23 and pivoted about its end to lift one side of the reflector 3, thus releasing the reflector 3 from the base 2.

The clips 40 therefore also serve as a release means for facilitating removal of the reflector 3 from the base 2.

It will be appreciated that the connector need not comprise a catch means or clip; it may be comprise any arrangement suitable for carrying out the necessary function. More specifically, it may comprise a different type of catch means such as one or more retractable pins or any other suitable arrangement. The connector may be arranged to provide an interference rather than a snap fit.

The connector need not be formed integrally with the reflector, for example it may be secured, such as releasably or permanently secured, thereto.

The reflector 3 need not comprise reflective strips, for example the reflector body 30 may itself comprise reflective surfaces, which may be secured to the body or formed integrally therewith. The reflector body 30 need not be symmetrical and/or substantially trapezoidal in cross section.

The resilient portion 41 of the connector 4 need not be of the form shown or described. For example it may be replaced by a completely separate resilient means such as a spring.

A second embodiment of the present invention is shown in FIGS. 6 to 19 which includes a road marker 110 having a base 112 (or housing) manufactured from cast iron or other suitable material.

In use, the base 112 is fitted to the road in a conventional manner.

The base 112 comprises opposed side walls 113 each having inward projections to receive and retain a reflector retaining cartridge 114. In this embodiment, the cartridge is provided with one or more flexible clips, shown in FIGS. 9 and 17. More specifically, the flexible clip 130A, 130B is a protrusion extending outwardly from the cartridge 114. The clip 130A, 130B is able to flex because the cartridge 114 is made from a suitable flexible polymer and due to the presence of an aperture 132A, 132B which runs parallel to each clip 130A, 1308 to allow them to flex both laterally and longitudinally.

In the illustrated embodiment, the cartridge 114 is provided with clamping means to clamp a road reflector 116.

Figure 17:
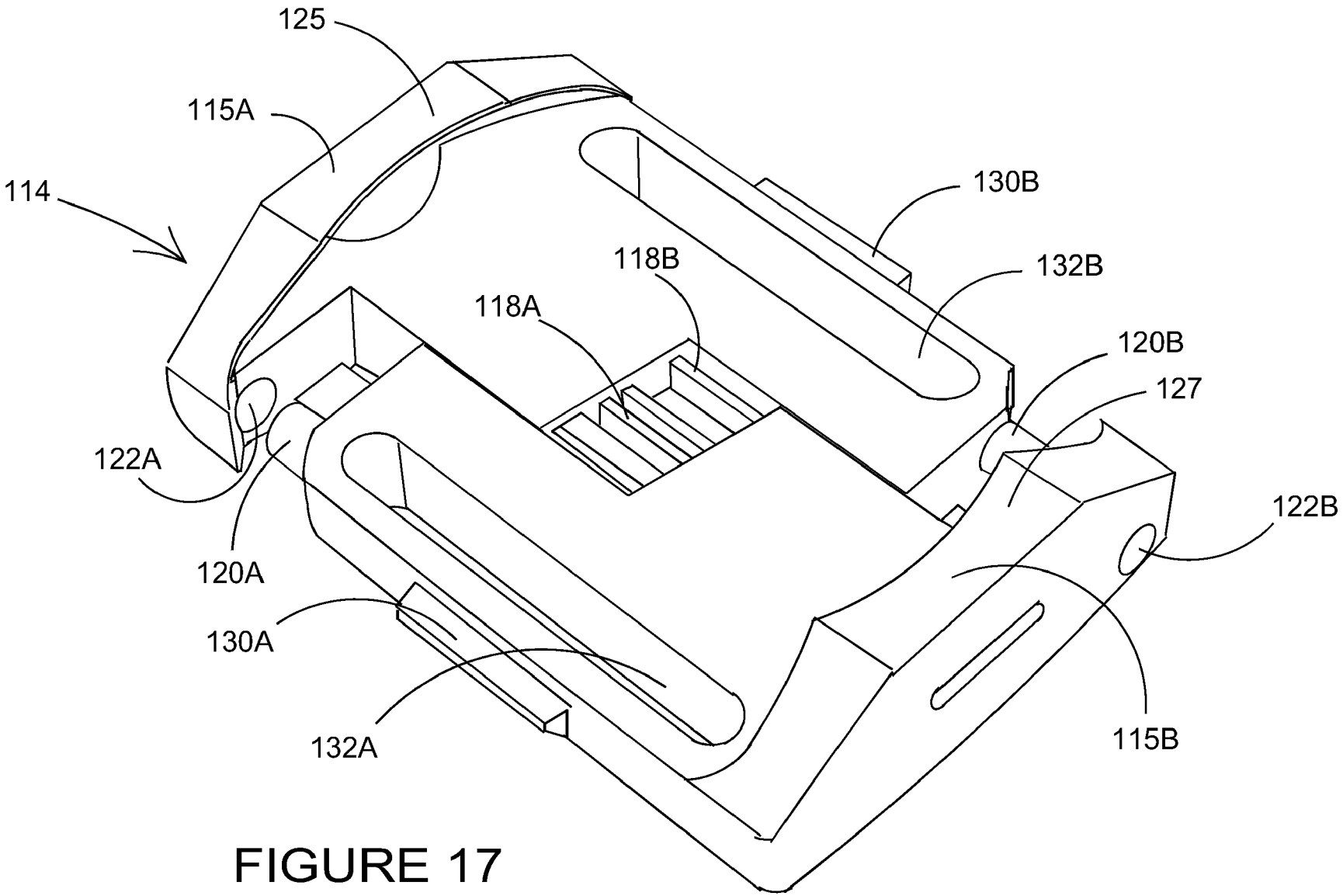
FIG. 17 is an enlarged view of FIG. 6.

The cartridge includes first and second clamp members 115A, 1158 as shown in FIG. 17 that are slidably connected by means of one or more inner guides 118A and 1188. In this embodiment, two guides are provided. Additional support pins 120A, 120B may also be provided to improve the integrity of the cassette in operation. The support pins 120A and 120B are received in corresponding apertures 122A and 122B respectively.

Figure 18:
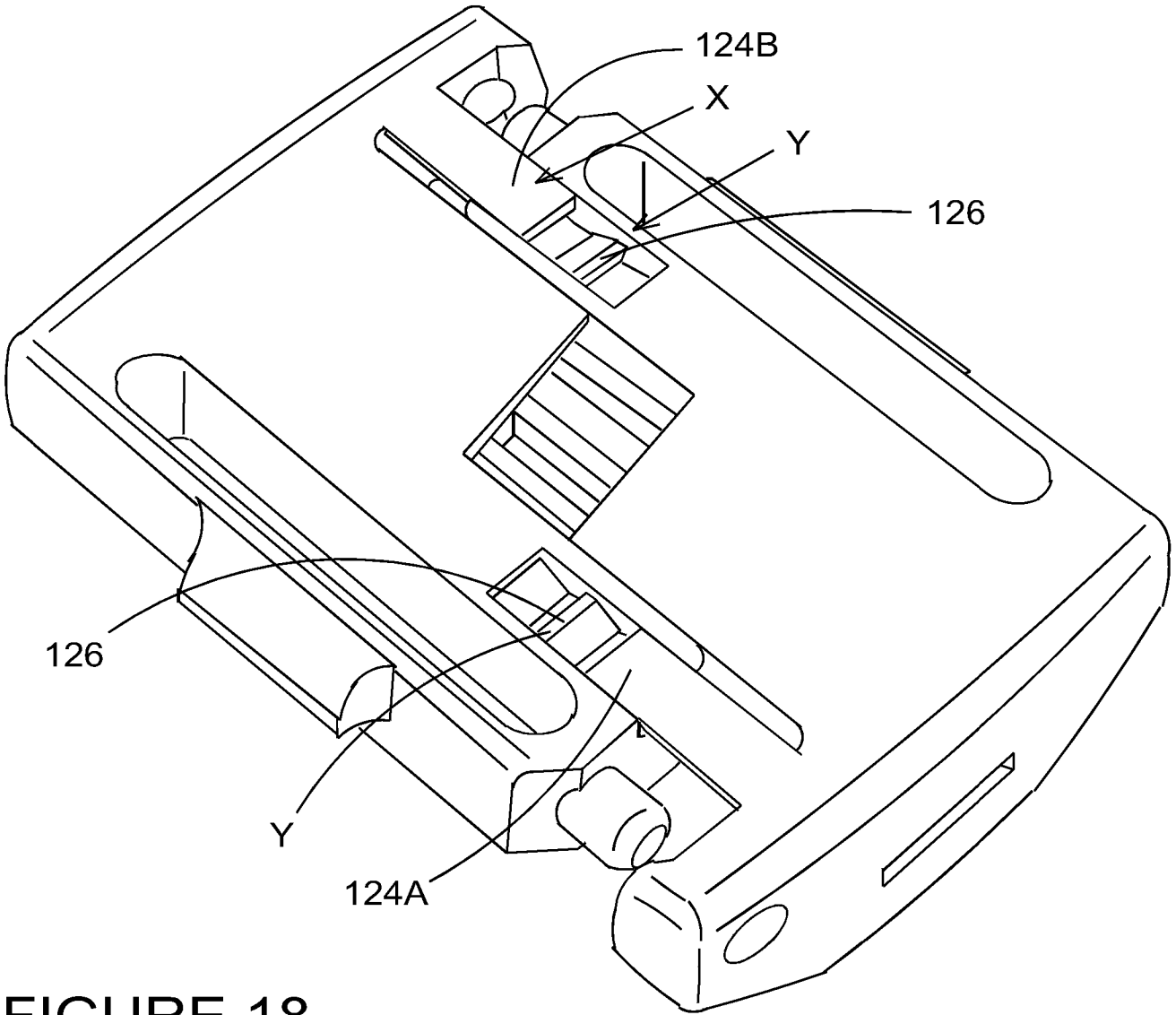
FIG. 18 is an enlarged view of FIG. 14.

A two stage lock is provided and shown in more detail in FIG. 18, whereby flexible "snap-on" clips 124A and 124B are provided which engage in corresponding protrusions 126 at two points X and Y. Thus the first and second members are held together at position X and lock the reflector in place at position Y.

Figure 7:
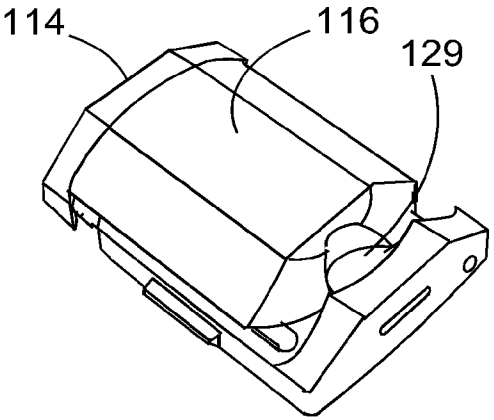
Figure 8:
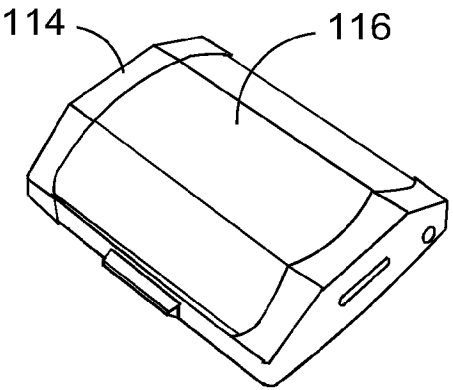
Figure 9:
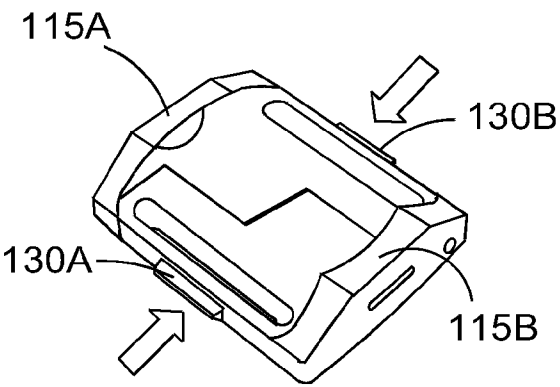
Figure 10:
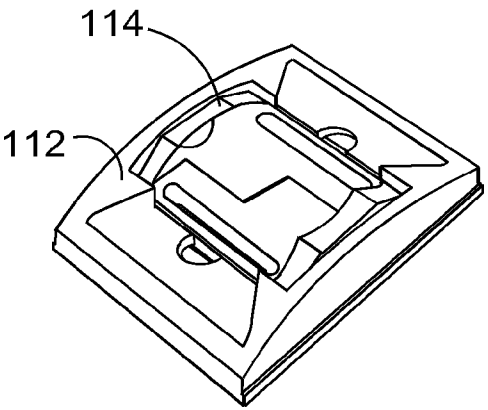

The clamping means is provided by protruding portions 125, 127 which extend inwardly from the first and second members 115A and 1158 to engage the road reflector 116, as shown in FIGS. 7 and 8.

In the illustrated embodiment, the protruding portions 125 and 127 engage corresponding recesses 129 formed in the reflector. Alternatively, the protruding portions 125 and 17 engage shoulders formed in the reflector.

The assembly is capable of securing various types of road reflector 116. In a preferred embodiment, the reflector is wedge shaped 129 so as to provide opposed surfaces to be secured to the cartridge. Thus the side walls of the reflector 116 are engaged by the protrusions 125, 127 and the lower edges are retained in corresponding edges at the intersection of the side walls and members 115A, 1158 as shown more clearly in FIG. 17.

In order to load the cartridge 114, the cartridge 114 is placed in an open position as shown in FIGS. 6, 14, 17 and 18. The reflector 116 is inserted into the cartridge (or cassette) as shown in FIG. 7 and the cartridge 114 is closed in a snap action as shown in FIG. 8.

Figure 11:
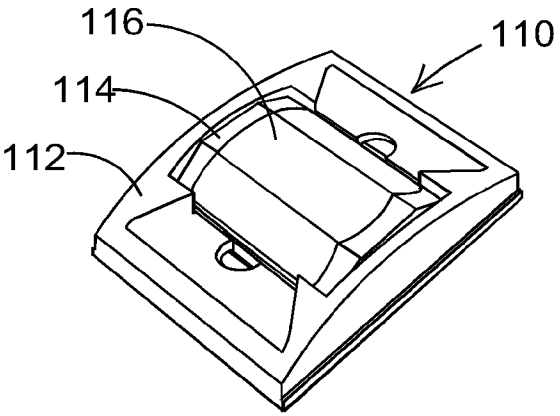
Figure 12:
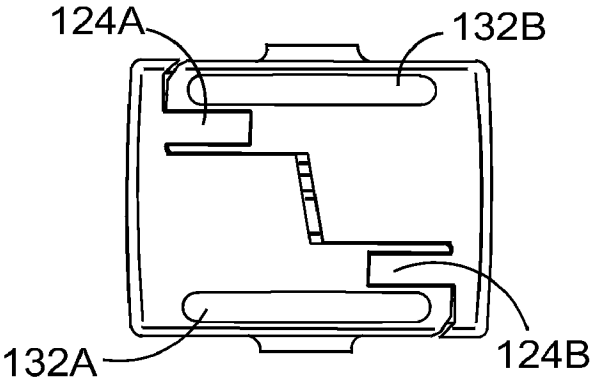
Figure 13:
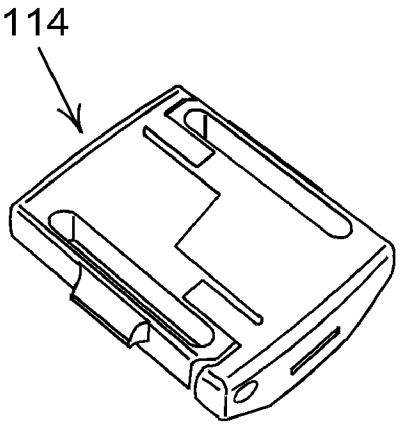
Figure 14:
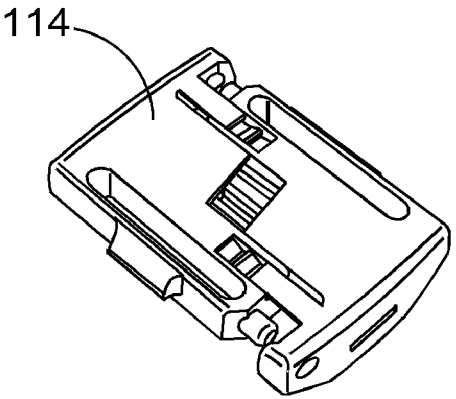
Figure 15:
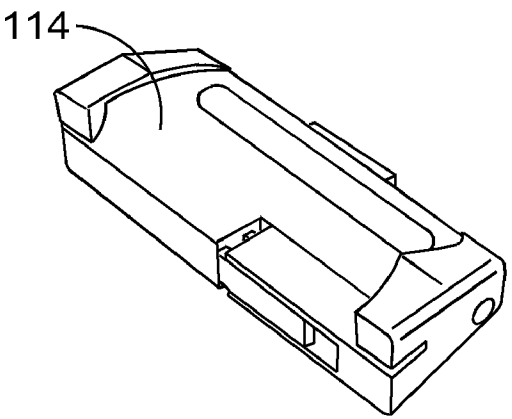
Figure 16:
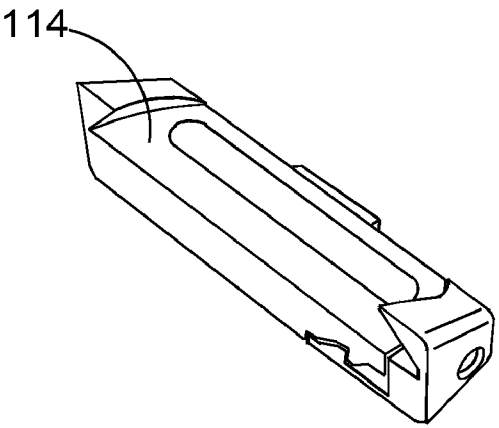
Figure 19:
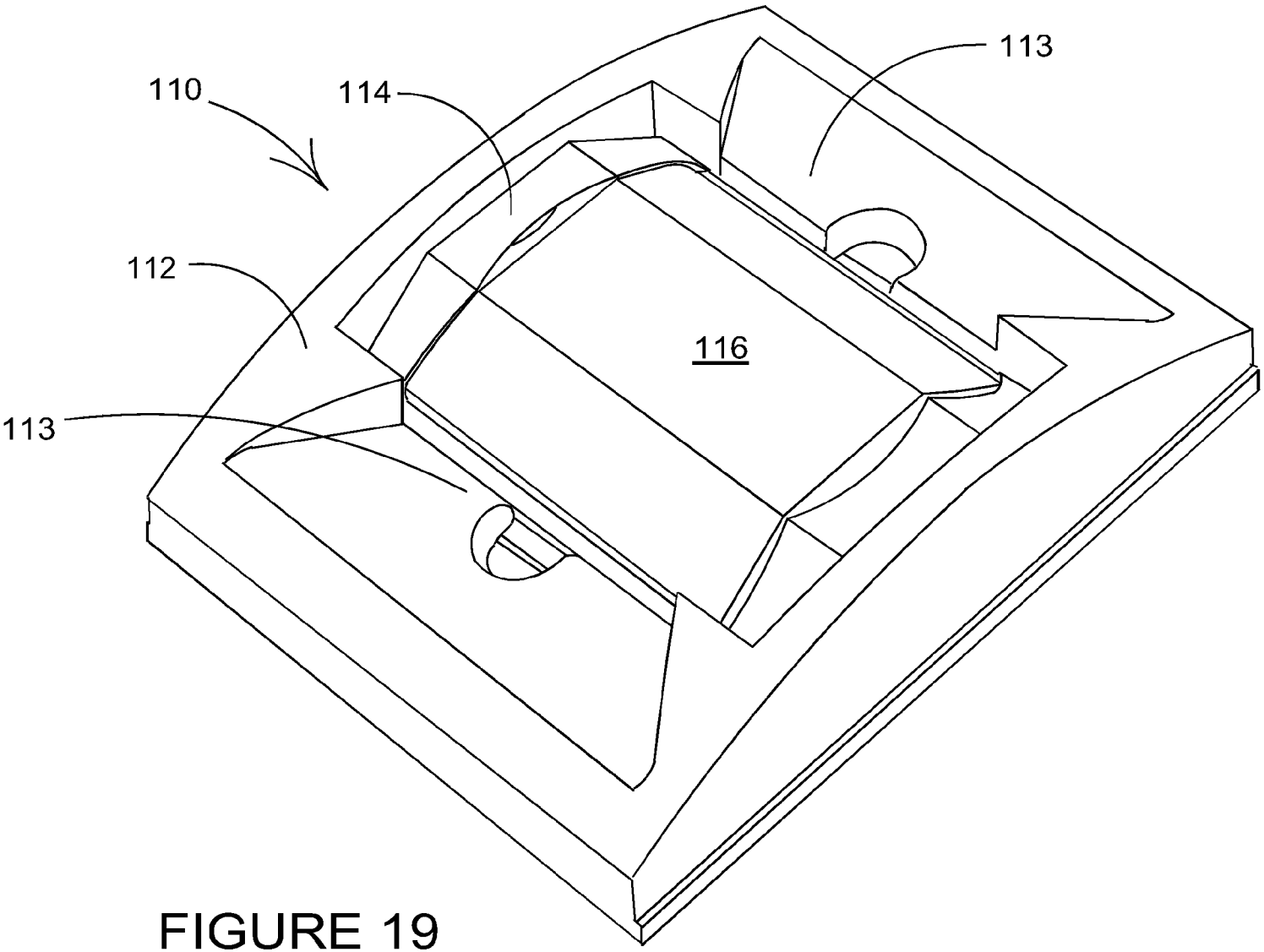
FIG. 19 is an enlarged view of FIG. 11.
Figure 20:
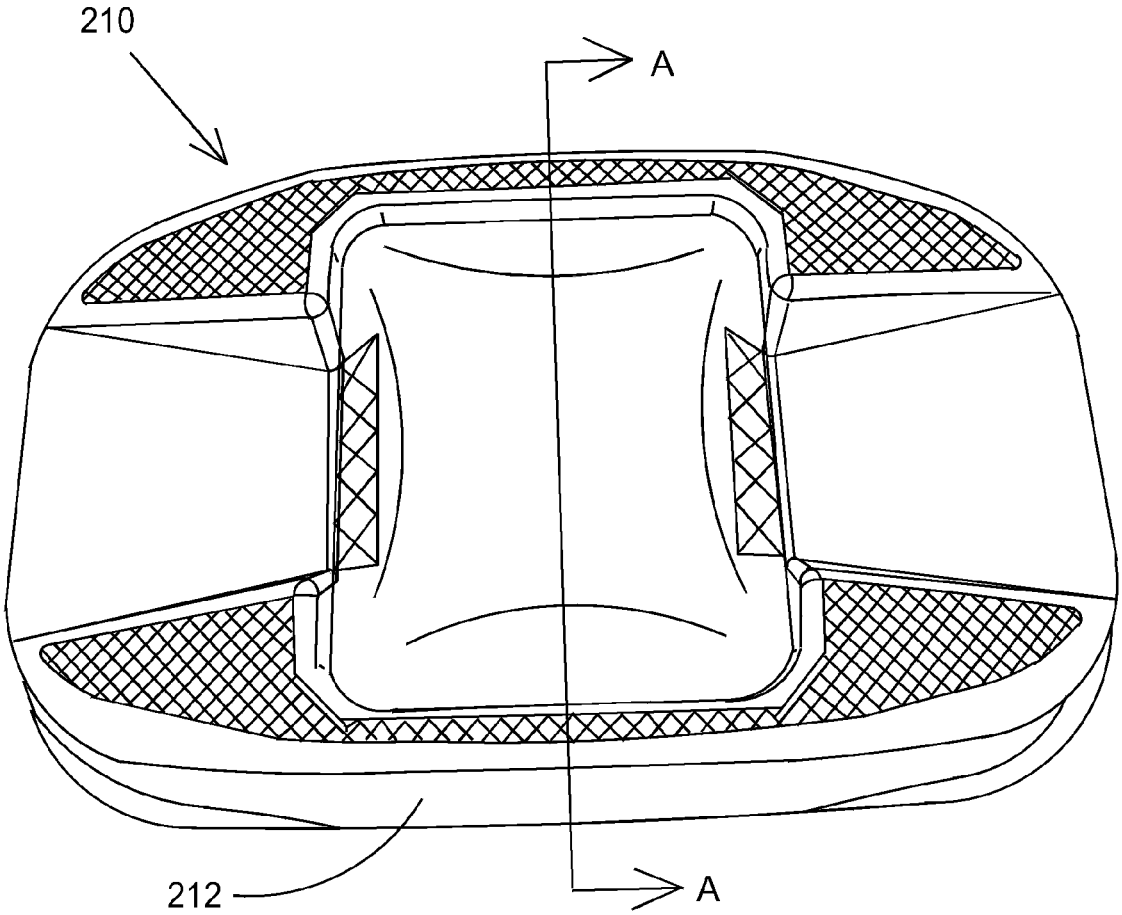
FIG. 20 is a perspective view of the road reflector according to a third embodiment of the invention.

The cartridge 114 and reflector 116 are then inserted into the base 112 and retained therein by the flexible clips 130A and 130B as shown in FIGS. 11 and 19.

The reflector 116 can be formed from suitable plastics material; but preferably it is formed as a co-polymer wherein the upper portion is formed from a hardened plastics material to retain the reflective elements and the lower portion connected to the cartridge 114 is made from a flexible polymer to allow it to flex when placed under compressive loads.

The cartridge 114 is capable of being removed by means of a simple tool such as a screw driver or pry bar, whereby the flexible clips 130A and 130B are forced in an upward direction thereby releasing the clamp and forcing the reflector out of the cartridge.

According to a third embodiment of the present invention, as shown in FIGS. 20 to 23, there comprises a road marker 210. The road marker 210 includes a base 212 (or housing) manufactured from cast iron or other suitable material. In use, the base is fitted to the road in a conventional manner.

The base 212 comprises opposed side walls 213 each having inward projections 215 defining recesses 217 to receive and retain a reflector retaining cartridge 214. In some embodiments, the base 212 further includes a pair of inwardly sloping surfaces 220 for receiving the reflector retaining cartridge 214.

In the illustrated embodiment, the cartridge 214 is provided with clamping means to clamp a road reflector 216. Of course, in other embodiments, the cartridge 214 is configured to secure the road reflector 216 by means of an "interference type" fitment or suitable adhesive.

The cartridge comprises opposed side walls 226A, 226B interconnected by opposed members 222, 224 that are in turn connected together about a pivot 219.

Figure 21:
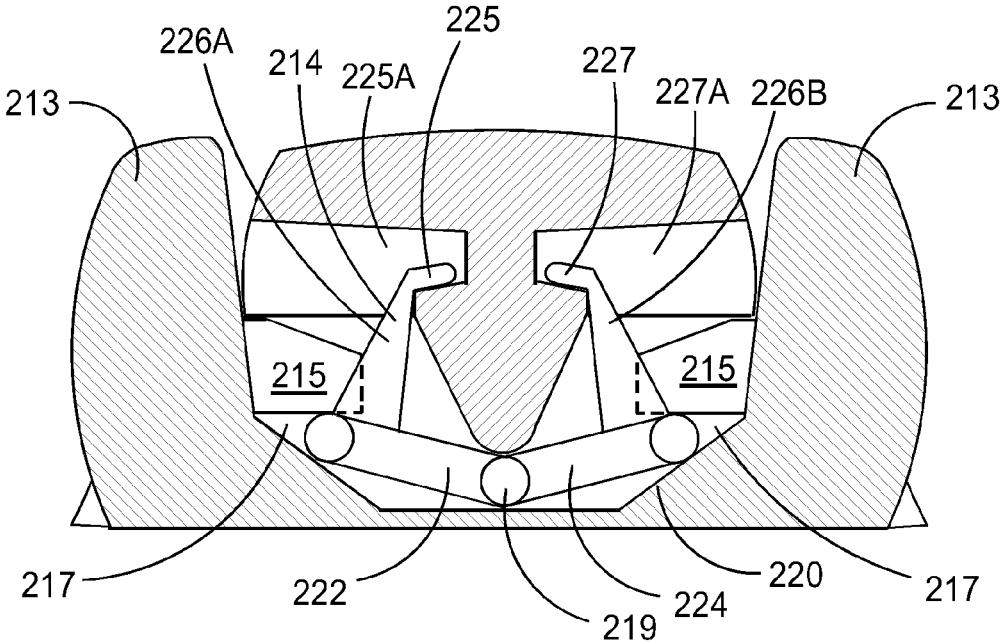
FIG. 21 is a cross section view of the road reflector of FIG. 20 through A-A with the reflector in situ.
Figure 23:
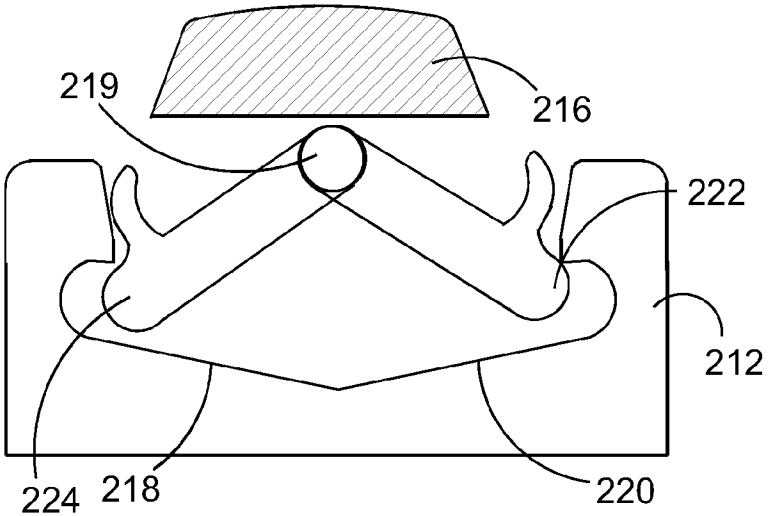
FIG. 23 is a cross section view of the third embodiment shown in FIG. 22 prior to securing the reflector to the base.
Figure 22:
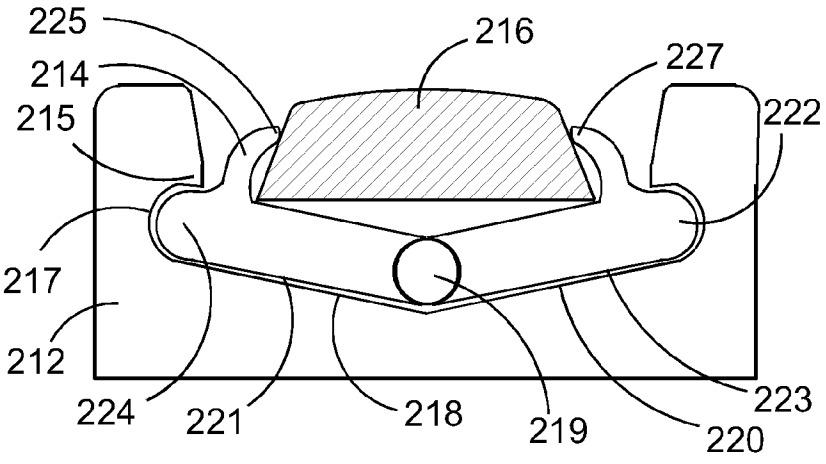
FIG. 22 is a cross section view of the road reflector of FIGS. 20 and 21 secured to the base.

In this embodiment, the pivot 219 is capable of pivoting the members 222, 224 from a position of rest shown in FIG. 23 to a position of use, whereby the pivot 219 and outer parts 222, 224 of the cartridge are not aligned as shown in FIGS. 21 and 22, thereby providing an "over-centre" securing arrangement. However, other securing means are envisaged without departing from the scope of invention.

The distance between the inner edges of the recesses 217 is less than the length of the members 222, 224 in order for the "over-centre" retention to take place. The benefit of this construction is that the weight of passing vehicles will increase the security of the assembly.

The clamping means is provided by the pivot 219 and protruding portions 225, 227 which extend inwardly from the side walls 226A, 226B to engage the road reflector 216, 220 as shown in FIG. 22. In the illustrated embodiment, the protruding portions 225 and 227 engage corresponding recesses 225A and 227A formed in the reflector.

Alternatively, the protruding portions 225 and 227 engage shoulders formed in the reflector, for example as shown in FIG. 22.

In an alternative embodiment, the cartridge 214 is made from suitable plastics material and the members 222, 224 are replaced with a single member that is shaped to flex when placed in compression. Thus, the member will flex in like manner as the pivot action.

The assembly is capable of securing various types of road reflector. In a preferred embodiment, the reflector is wedge shaped as shown in FIG. 21 so as to provide opposed surfaces to be secured to the cartridge. In another arrangement, the side walls of the reflector (e.g. 430, 432 shown in FIG. 25) are engaged by the protrusions 225, 227 and the lower edges 434, 436 are retained in corresponding edges at the intersection of the side walls 226A, 226B and members 222, 224.

Figure 25:
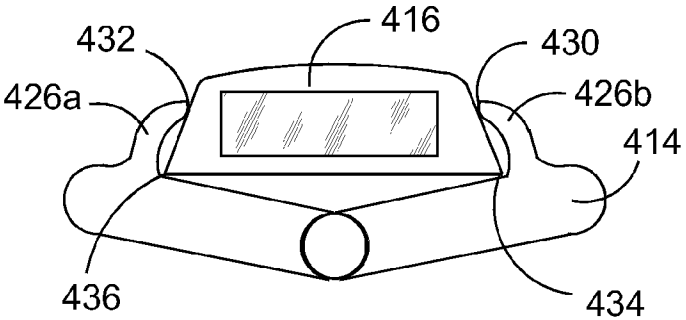
FIG. 25 illustrates a fourth embodiment in which an alternative reflector is retained by the cartridge.
Figure 24:
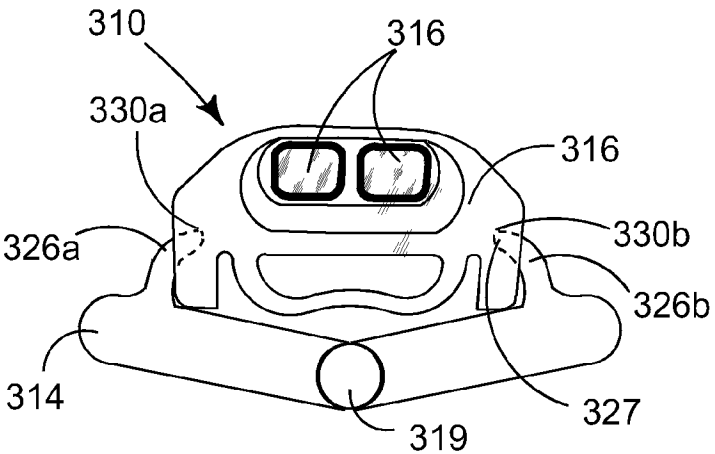
FIG. 24 illustrates a third embodiment of reflector using the "Shaw" reflector mounted to a cartridge.

Alternative configurations are shown in FIGS. 24 and 25, like parts have been designated by the same reference numerals with the prefix "3" or "4" respectively and shall not therefore be described in any greater detail. In this embodiment, the reflector 316 is a traditional "Shaw" style of road reflector, which is secured to the cartridge 314 by means of recesses (or apertures) 330A and 330B which are shaped to receive the protrusions 326A, 326B to be retained therein.

In FIG. 25, the reflector is another common reflector on the market and is retained by the cartridge 414 by clamping onto opposed shoulders 465, 467 formed in the side walls of the reflector.

The reflector 116 can be formed from suitable plastics material; but preferably it is formed as a co-polymer wherein the upper portion is formed from a hardened plastics material to retain the reflector elements and the lower portion connected to the cartridge is made from a flexible polymer to allow it to flex when placed under compressive loads.

The cartridge 214, 314, 414 is capable of being removed by means of a simple tool such as a screw driver or pry bar, whereby the members 222, 224 are forced in an upward direction releasing the clamp and forcing the reflector out of the cartridge.

Beneficially, the arrangement of road marker hereinbefore described, means that the base 12, 112, 212, 312, 412 can remain in the road, which reduces the need to dig up the road.

The support means is adapted to hold different styles of reflector, for example the Shaw design, Samsonite and 3M designs.

Furthermore, it is envisaged that different of support means can be incorporated into the base, without departing from the scope of invention.

It will be understood that directional terms such as "inner," "outer," "front," "rear", "top", "upper" and "lower" and "side" and the like serve, where used herein, merely to differentiate components of the present invention from one another; their respective components should not be considered to be limited to those orientations, and other reasonable orientations may be adopted without departing from the scope of the present invention.

It will also be appreciated by those skilled in the art that any number of combinations of the aforementioned features and/or those shown in the appended drawings provide clear advantages over the prior art and are therefore within the scope of the invention described herein.

The invention claimed is:

1. An embedded-type reflective road marker comprising a base, a reflector for reflecting light cast onto the marker and a reflector retention cartridge detachably connected or secured, in use, to the base, the-reflector retention cartridge having first and second members that are slidable relative to one another to clamp and engage the reflector between said first and second members in order to detachably secure the reflector to the cartridge and release means for facilitating removal of the reflector retention cartridge from the base.

2. A marker as claimed in claim 1, wherein the release means comprises a first clip.

3. A marker as claimed in claim 2, wherein at least a portion of the first clip is resiliently biased, in use, toward the base to provide a snap fit therewith.

4. A marker as claimed in claim 2, wherein the first clip comprises a projection at or adjacent its free end which engages, in use, a recess or aperture in a facing wall of the base.

5. A marker as claimed in claim 4, wherein the first clip comprises a resilient portion arranged to urge resiliently, in use, the projection toward the recess or aperture in the base.

6. A marker as claimed in any claim 2, wherein the release means further comprises a second clip disposed on an opposite side of the reflector to the first clip, the second clip including a projection at or adjacent its free end which engages, in use, a second recess or aperture in a facing wall of the base.

7. A marker as claimed in claim 6, wherein the second clip comprises a resilient portion arranged to urge resiliently, in use, the projection toward the recess or aperture in the base.

8. A marker as claimed in claim 1, wherein the clamping means comprises opposed protruding portions extending inwardly and adapted to engage shoulders of the reflector.

9. A marker as claimed in claim 1, wherein the first and second members are provided with interengaging means to lock the cartridge in a reflector engaged position.

10. A marker as claimed in claim 1, wherein the reflector retention cartridge is provided with one or more inner guides to guide the first and second members between an open and locked positions.

* * * * *